United States Patent [19]

Spielman et al.

[11] Patent Number: 4,669,770

[45] Date of Patent: Jun. 2, 1987

[54] GOLF BALL RETRIEVER

[75] Inventors: Rodney J. Spielman, Vernon; Donald J. Allison, Manchester, both of Conn.

[73] Assignee: Golftech Inc., Ellington, Conn.

[21] Appl. No.: 896,875

[22] Filed: Aug. 15, 1986

[51] Int. Cl.[4] ..... A63B 47/02

[52] U.S. Cl. ..... 294/19.2; 56/328 R; 414/440

[58] Field of Search ..... 294/19.2, 99.1; 56/328 R, 332, 400.02, 400.03, 400.11, 400.12; 171/58, 63; 273/32 F, 162 E; 414/437, 439, 440

[56] References Cited

U.S. PATENT DOCUMENTS

| | | | |
|---|---|---|---|
| 2,365,540 | 12/1944 | Fonken | 56/328 R X |
| 2,812,871 | 11/1957 | Woodall | 414/440 |
| 3,136,573 | 6/1964 | Harke | 294/19.2 |
| 3,215,293 | 11/1965 | Kelly et al. | 294/19.2 X |
| 3,227,298 | 1/1966 | Shoemaker | 294/19.2 X |
| 3,306,480 | 2/1967 | Wysong | 414/440 |
| 3,437,368 | 4/1969 | Anderson | 294/19.2 |
| 3,604,190 | 9/1971 | Wray | 294/19.2 X |
| 3,784,037 | 1/1974 | Woodall | 414/440 |
| 3,788,506 | 1/1974 | Lee | 414/440 |
| 3,923,101 | 12/1975 | Donohue | 294/19.2 X |
| 4,066,179 | 1/1978 | Livingston | 414/440 |
| 4,318,654 | 3/1982 | Lee | 294/19.2 X |
| 4,593,519 | 6/1986 | Kimball | 414/440 X |

OTHER PUBLICATIONS

Austad's 1986 Golfer's Preview Catalog showing five state of the art golf ball retrievers.

*Primary Examiner*—Johnny D. Cherry

[57] ABSTRACT

A device for retrieving golf balls consists of a pair of discs rotatably mounted upon a plastic body. The shaft used to rotatably support the discs also serves to maintain the prongs of the body in a spaced relationship in which they develop an optimal amount of force upon the discs. The head assembly consists of only a few parts, and no supplemental means is necessary to secure them.

11 Claims, 7 Drawing Figures

FIG. 2
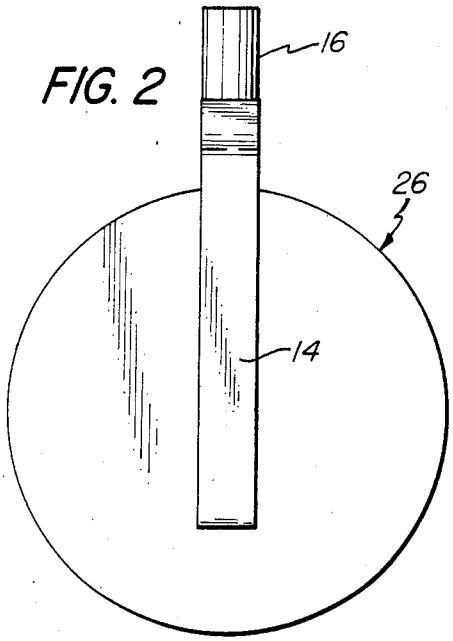
FIG. 3
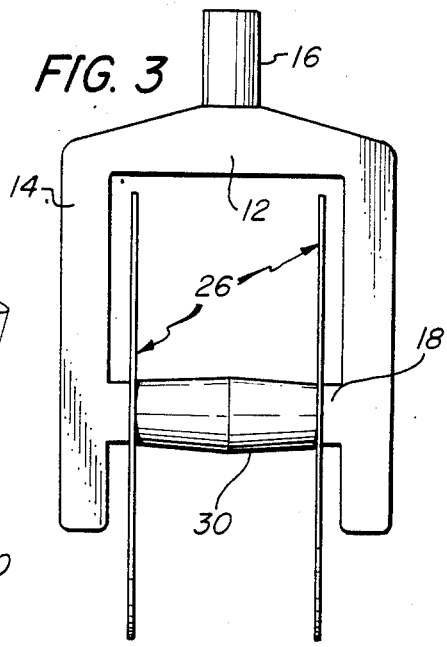
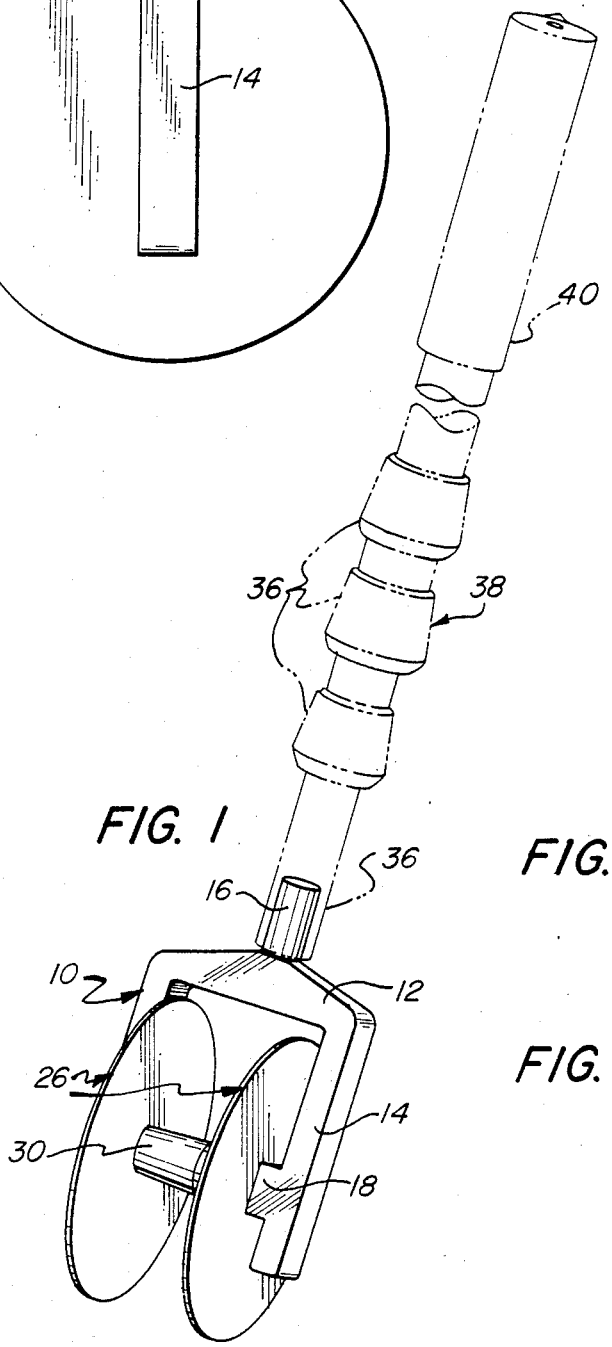
FIG. 1
FIG. 4
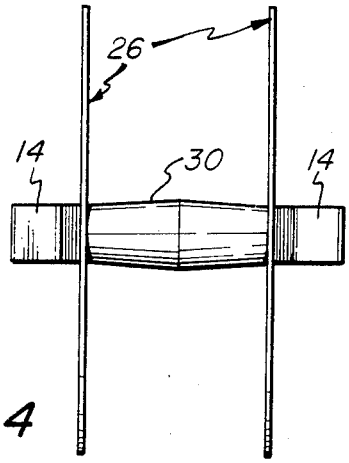
FIG. 5
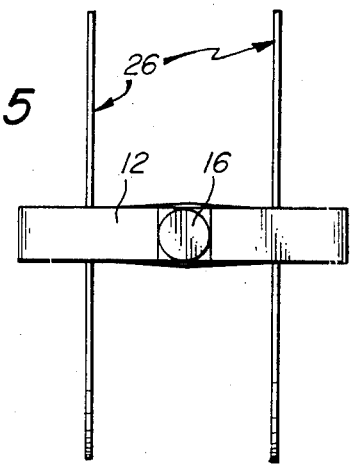

GOLF BALL RETRIEVER

BACKGROUND OF THE INVENTION

Golfs balls are frequently lost during play because they are not readily visible and/or are difficult to reach or to get at (e.g., in a water hazard). A considerable variety of devices and machines have been proposed in the art for picking up balls and other objects from the ground, as typified by the inventions of the following U.S. patents:

| U.S. Pat. No. | Patentee |
|---|---|
| 2,365,540 | M. E. Fonken |
| 2,812,871 | L. Woodall |
| 3,136,573 | R. J. Harke |
| 3,215,293 | J. T. Kelly et al |
| 3,227,298 | J. C. Shoemaker |
| 3,306,480 | H. G. Wysong |
| 3,437,368 | R. F. Anderson |
| 3,604,190 | J. B. Wray |
| 3,784,037 | L. Woodall |
| 4,066,179 | A. K. Livingston |
| 4,318,654 | D. Lee |

Despite the activity indicated by the foregoing, a need remains for a device that is highly effective for retrieving golf balls, and which is nevertheless of uncomplicated and relatively inexpensive construction and is relatively facile to produce and easy to use.

Accordingly, it is the broad object of the present invention to provide a novel device for retrieving golf balls and the like, which is highly effective and convenient to employ, and which consists of only a few parts which are readily assembled, thereby rendering manufacture relatively facile and inexpensive.

Additional objects of the invention are to provide a device having the foregoing features and advantages, in which the operating discs are optimally supported, which is effective for retrieving golf balls despite an inability to see them, and which is durable and employs certain parts that are standard articles of commerce.

SUMMARY OF THE INVENTION

It has now been found that the foregoing and related objects of the invention are readily attained in a device including a head assembly comprised of a forked body, which is integrally formed, as a single piece, from a synthetic resinous material. The body consists of at least two laterally spaced, generally parallel prong portions, each having an inwardly extending boss element thereon with a socket formed into it and providing a bearing surface thereabout, the sockets being in lateral alignment with one another. A shaft is supported between the prong portions with its opposite end portions seated within the sockets, and at least two discs are rotatably mounted upon the shaft and are spaced from one another with their outer surfaces in contact with the bearing surfaces of the prong portion boss elements. At least one generally tubular spacer will normally be mounted upon the shaft with its opposite ends providing surface elements bearing upon the inside surfaces of the discs. The distance between the discs is slightly less than the diameter of the balls that are to be retrieved using the device, and the discs are resiliently deflectable so as to receive the balls within the cylindrical space that they define and to wedge them therebetween. The prong portions are of sufficient resilience to permit them to be spread from normal positions (i.e., the positions they would assume if not restrained and not externally stressed), for insertion of the shaft end portions into their sockets, and to thereafter return toward their normal positions so as to cause the bearing surfaces of the boss elements to bear upon the discs. The prong portions also serve to maintain the shaft, discs and spacer in snug assembly on the body, without need for supplemental securing means.

In the preferred embodiments of the device, portions of the shaft (normally the opposite end surfaces) will be in contact with the surfaces that define the sockets in the prong portions (normally at the inner ends), so that the shaft will serve to limit their inward movement toward one another and toward their normal positions, and thereby to establish optimal spacing. The shaft and the discs will desirably be of metal construction, and when the device is to be used for golf ball retrieval the shaft will most advantageously be a 2-inch steel rod and the discs will be made of aluminum, about 30-thousandths of an inch in thickness and $3\frac{3}{4}$ inch in diameter. In particularly preferred embodiments, the assembly will be devoid of separate parts other than the body, the shaft, the discs and the spacer.

The body of the device may be of generally U-shaped configuration, comprised of a crosspiece from which the prong portions extend generally perpendicularly. A cylindrical stub element may extend in the opposite direction from a central position on the crosspiece, and the device may additionally include a handle having an end portion with a socket to frictionally engage the stub element for mounting the head assembly; generally, the handle employed will be of adjustable length.

As an alternative embodiment, the body of the device may be of trident form, including an internal prong portion equidistantly spaced between the outer ones and having a boss on each of its lateral sides. Such an assembly will also include a second pair of discs, a second tubular spacer (or other spacing means), and a second shaft, one of the shafts being supported between each outside prong and the internal prong, with a pair of the discs and one of the spacers mounted as hereinabove described, so as to provide two ball retrieval effects.

BRIEF DESCRIPTION OF THE DRAWINGS

FIG. 1 is a perspective view of a ball-retrieval device embodying the present invention, wherein the handle is fragmentarily illustrated and shown in phantom line;

FIG. 2 is a side elevational view of the head assembly employed in the device of FIG. 1, drawn to a scale slightly enlarged therefrom;

FIG. 3 is a front (or rear) elevational view of the head assembly;

FIG. 4 is a bottom view thereof;

FIG. 5 is a top view thereof;

DETAILED DESCRIPTION OF THE ILLUSTRATED EMBODIMENTS

Figure 6:
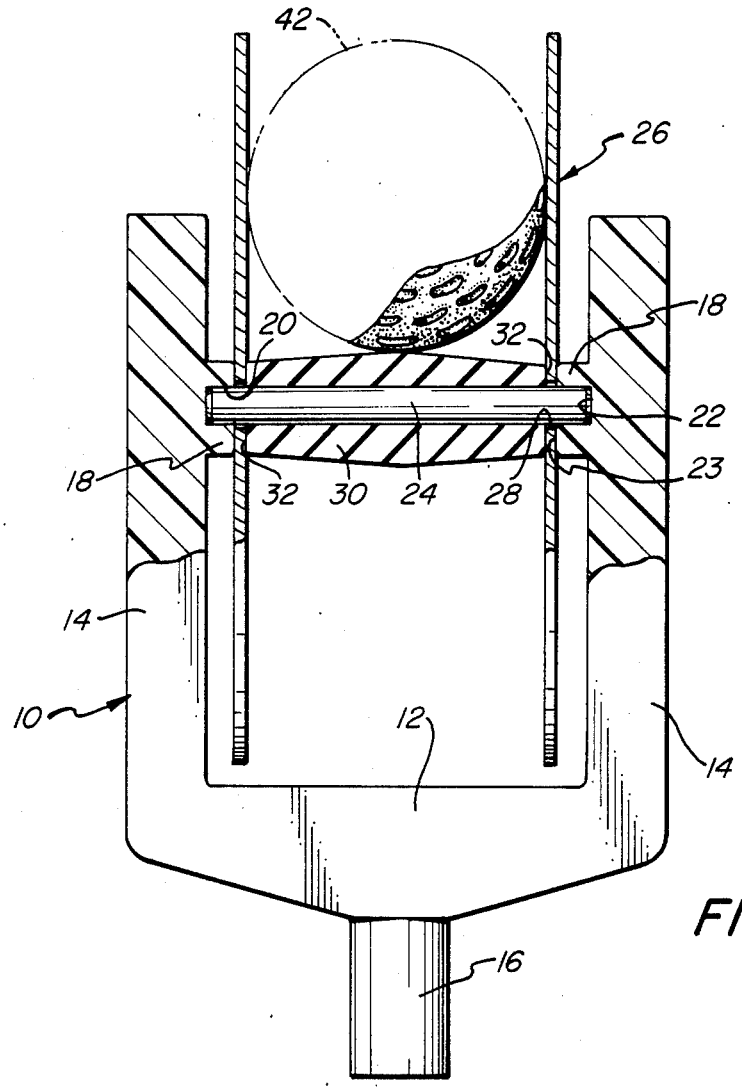
FIG. 6 is a view of the head assembly similar to that of FIG. 3, drawn in partial section and to a scale greatly enlarged therefrom, and showing a golf ball wedged between the discs thereof.

Turning now in detail to FIGS. 1–6 of the appended drawings, therein illustrated is a ball-retrieval device embodying the present invention. The unique feature of the device is its head assembly, which is most fully illustrated in FIG. 6 and consists of a one-piece, substantially U-shaped body, generally designated by the numeral 10. The body 10 comprises a crosspiece 12, having prong portions 14 extending parallel to one another from its outer ends and a cylindrical lug portion 16 centrally disposed thereon and extending in the opposite direction; a boss element 18 is formed on the inside surface of each prong portion 14. The two boss elements 18 are laterally aligned with one another and each defines a socket 20 with an end wall surface 22, and has a bearing surface 23 on its innermost end.

A cylindrical metal rod 24 has its opposite end portions seated snugly within the sockets 20 of the prong portion boss elements 18, to span the distance therebetween. As will be noted, the end wall surfaces 22 bear directly upon the confronting surfaces on the ends of the rod 24.

A pair of flat, thin identical discs, generally designated by the numeral 26, are rotatably supported the shaft 24, which is inserted through the circular aperture 28 at the center of each. Also mounted upon the shaft, between the discs 26, is a sleeve-like spacer 30 of generally tubular form, the end surfaces 32 of which bear upon the inner surfaces of the discs 26 about the apertures 28 therethrough. The discs are held in place by the prong portions 14, with the surfaces 23 on the boss elements 18 bearing thereupon.

As seen in FIG. 1, the cylindrical stub 16 on the head assembly body 10 is engaged within the smallest of the tubular sections 36 of the handle, which is generally designated by the numeral 38. Internal mechanism (not shown) of the handle 38 allows the telescoped sections 36 to be fixed in any extended position relative to one another, in a conventional fashion, and the grip 40 facilitates grasping by the user.

The manner of use of the ball-retrieval device will be self-evident, and simply involves rolling the discs 26 along the ground in the vicinity in which a golf ball is suspected to lie. Because of the spacing between the discs, relative to the ball diameter, and their inherent flexibility, movement over a ball will cause it to become wedged between them. Rolling the device back-and-forth through a water hazard will therefore provide an effective way of recovering balls even though they are not visible; in the embodiment of FIGS. 1–6, as many as four balls can be picked up as a practical matter.

As will be appreciated, the spacing between the discs and their ability to rotate relatively freely are of primary importance to proper operation of the device. The construction described has proven to be a most desirable way of ensuring that both functions will be afforded.

The synthetic resinous material utilized for fabricating the body of the head assembly (and conveniently, also the sleeve-like spacer) will have a degree of resilient deflectability; a glass-filled polycarbonate (about 30 percent loading) will advantageously be used. If the mold dimensions are selected to provide a given distance between the free ends of the prong portions, the shrinkage that normally occurs upon cooling will cause them to have a tendency to spring inwardly beyond the point at which they will generate an optimal level of friction upon the discs. Some force is of course desirable to keep the discs from wobbling on the shaft, but at the same time it must not inhibit them from rotating relatively freely.

Because the shaft 24 has its end surfaces bearing directly upon the end surfaces 22 defining the sockets 20, it will serve not only to mount the discs but also to precisely control the level of clamping force that is exerted thereupon by the prong portions 14. The sleeve-like spacer 30 cooperates therewith, and will be of a length that is suitable to contact the inner surfaces of the discs without producing excessive frictional drag.

Due to the unique construction described, assembly of the parts comprising the head unit is most facile. It is done by spreading the prong portions 14 in a jig, or by other suitable means (not shown), just far enough to permit insertion of the rod 24 (on which the discs and spacer are of course preassembled). After the ends of the rod are aligned with the sockets 20, the spreading force is removed; the inherent resilience of the prong portions causes them to close upon the discs, securely mounting the parts, as described.

As will be appreciated, to function properly it is necessary that the discs 26 deflect slightly so as to accommodate the ball 42 therebetween. In those instances in which the device is specifically designed for retrieving golf balls (regulation U.S. size being about 1.675 inches in diameter), the discs will most advantageously be spaced about 1.60 inches apart and be fabricated from aluminum sheet that is 30-thousandths of an inch thick and is approximately $3\frac{3}{4}$ inch in diameter. The spacing will normally be achieved simply by making the spacer sleeve the same length as is desired between the discs; the mounting shaft can simply be a standard 2-inch metal rod.

Figure 7:
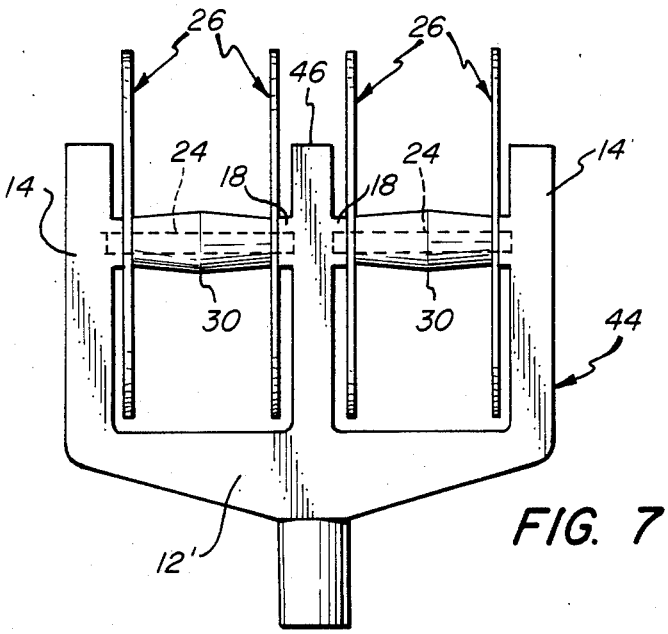
FIG. 7 is a front view illustrating a second form of head assembly embodying the present invention, in which a double retrieval effect is provided.

Turning now to FIG. 7 of the drawings, therein illustrated is a second embodiment of the devices of the invention in which a double effect is provided. It consists of parts that are essentially the same as those of the previous embodiment, with the exception that the body of the head assembly, generally designated by the numeral 44, is of W-shaped configuration and includes an internal prong portion 46, which is equidistantly spaced from the outer prong portions 14. The internal prong portion 46 has a cylindrical boss 18 on both of its opposite lateral side surfaces, which provide two additional sockets 22, one of which is aligned with the confronting socket of each of the outside prong portions 14. A rod 24 is employed to mount a pair of discs 26 and one spacer 30 between the interior prong portion 46 and each of the exterior prong portions 14, in the manner hereinabove described.

As will be appreciated, various modifications can be made in the device and its structural features without departing from the concepts of the present invention. For example, although the retriever is intended primarily for use with golf balls and is expected to have its major utility for that purpose, other kinds of balls can be retrieved with such a device; changes in dimensions and structural characteristics of the discs and supporting parts will of course be made, as appropriate. Also, other materials can be utilized in the construction of the several parts of the device, as will be evident to those skilled in the art.

Thus, it can be seen that the present invention provides a novel device for retrieving golf balls and the like, which is highly effective and convenient to employ, and which consists of only a few parts which are readily assembled, thereby rendering manufacture relatively facile and inexpensive. The operating discs are optimally supported on the body, and the device is of durable construction.

Having thus described the invention, what is claimed is:

1. In a device for retrieving golf balls and the like, a head assembly comprised of a forked body which is integrally formed, as a single piece, from a synthetic resinous material, said body including at least two laterally spaced, generally parallel prong portions each having an inwardly extending boss element thereon with a socket formed thereinto and providing a bearing surface thereabout, said sockets being in lateral alignment with one another; a shaft supported between said prong portions and having opposite end portions seated within said sockets; at least two discs rotatably mounted upon said shaft and spaced laterally from one another to define a generally cylindrical space therebetween; and spacing means providing surface elements against which the inside surfaces of said discs bear to maintain them in said laterally spaced relationship, the distance between said discs being slightly less than the diameter of the balls that are to be retrieved with said device, and said discs being resiliently deflectable to receive such balls within said space and to wedge them therebetween, said prong portions having sufficient resilience to permit spreading from normal positions, for insertion of said shaft end portions into said sockets, and to thereafter return toward said normal positions to cause said bearing surfaces of said prong boss elements to bear upon said discs and to maintain said shaft and discs in assembly with said body, without need for supplemental securing means.

2. The device of claim 1 wherein, by contact of said opposite end portions with surfaces defining said sockets, said shaft serves to limit inward movement of said prong portions toward said normal positions thereof.

3. The device of claim 2 wherein said shaft is a 2-inch metal rod and said discs are made of aluminum, are spaced from one another by about 1.6 inches, and are about 30-thousandths of an inch in thickness and $3\frac{3}{4}$ inch in diameter, said device being adopted for retrieving golf balls.

4. The device of claim 1 wherein said shaft and discs are of metal construction.

5. The device of claim 1 additionally including at least one generally tubular spacer mounted upon said shaft and providing said spacing means, said surface elements being on the opposite ends thereof, and wherein said assembly is devoid of separate parts in addition to said body, shaft, discs and spacer.

6. The device of claim 1 wherein said body is of generally U-shaped configuration.

7. The device of claim 6 wherein said body comprises a crosspiece from which said prong portions extend generally perpendicularly, and has a cylindrical stub element extending in the direction opposite to said prong portions in a central position thereon for attachment of a handle to said body.

8. The device of claim 7 additionally including an elongated handle extending from said head in a direction opposite and generally parallel to said prong portions, said handle having an end portion with a socket formed thereinto within which said stub element is frictionally engaged to disengageably mount said assembly thereon.

9. The device of claim 8 wherein said handle is of adjustable length.

10. The device of claim 1 wherein said body is of trident form and includes an internal prong portion equidistantly spaced between said first-mentioned two prong portions and extending parallel thereto and in the plane thereof, said internal prong portion having a boss on each side facing said first-mentioned prong portions and aligned with said boss elements thereon, said assembly also including a second pair of said discs, a pair of tubular spacers, and a second of said shafts, one of said shafts being so supported between each of said first-mentioned prong portions and said internal prong portion, with a pair of said discs so mounted thereon to provide two ball-retrieval effects on said head assembly, one of said spacers being mounted upon each of said shafts to provide such spacing means and, on the opposite ends thereof, such surface elements for each of said pairs of discs.

11. In a method for the production of a head assembly for a device for retrieving golf balls and the like, the steps comprising: integrally forming a forked body as a single piece from a resiliently deflectable synthetic resinous material, said body including at least two laterally spaced, generally parallel prong portions each having an inwardly extending boss element thereon with a socket formed thereinto and providing a bearing surface thereabout, said sockets being in lateral alignment with one another; providing a shaft, at least two centrally apertured discs, and spacing means; rotatably mounting said discs upon said shaft with said spacing means therebetween and spaced laterally from one another to define a generally cylindrical space, the distance between said discs being slightly less than the diameter of the balls that are to be retrieved with said device, and said discs being resiliently deflectable to receive such balls within said space and to wedge them therebetween; spreading said prong portions; inserting the opposite end portions of said shaft into said sockets; and permitting said prong portions to resiliently return toward the normal positions thereof to cause said bearing surfaces of said prong boss elements to bear upon said discs and to maintain said shaft and discs in assembly with said body, without need for supplemental securing means.

* * * * *